US005391964A

United States Patent [19]

Lim

[11] Patent Number: 5,391,964

[45] Date of Patent: Feb. 21, 1995

[54] MAGNETRON YOKE JOINT HAVING BENT JOINING LUGS

[75] Inventor: Jong H. Lim, Seoul, Rep. of Korea

[73] Assignee: Goldstar Co., Ltd., Seoul, Rep. of Korea

[21] Appl. No.: 988,526

[22] Filed: Dec. 10, 1992

[30] Foreign Application Priority Data

Dec. 14, 1991 [KR] Rep. of Korea ..... 91-22287

[51] Int. Cl.[6] ..... H01J 23/10; H01J 25/50

[52] U.S. Cl. ..... 315/39.71; 315/39.51

[58] Field of Search ..... 315/39.51, 39.71; 313/158, 159

[56] References Cited

FOREIGN PATENT DOCUMENTS

| | | | |
|---|---|---|---|
| 114256 | 9/1981 | Japan | 315/39.51 |
| 133633 | 7/1985 | Japan | 315/39.51 |
| 61-110937A | 5/1986 | Japan . | |
| 119634 | 5/1991 | Japan | 315/39.51 |

*Primary Examiner*—Benny T. Lee

*Attorney, Agent, or Firm*—Morgan & Finnegan

[57] ABSTRACT

Yoke joints of a magnetron for generating microwaves include joining lugs having holes protruding out from the upper edges of each end of a plane part of a lower yoke and catches provided in an upper yoke to join with the above joining lugs. The upper and lower yokes are joined by means of above joining lugs provided in the lower yoke and catches provided in the upper yoke and the magnetron is connected to an electronic range by means of the above joining lugs.

3 Claims, 4 Drawing Sheets

MAGNETRON YOKE JOINT HAVING BENT JOINING LUGS

BACKGROUND OF THE INVENTION

1. Field of the Invention

The present invention relates to magnetron yoke joints.

2. Description of the Related Art

Generally, as shown in FIG. 1, a magnetron is a kind of two pole electronic tube which comprises cathode 1 arranged in series at the center of the magnetron and anode 2 arranged radially around above cathode 1.

An upper yoke 30 and a lower yoke 20 are provided to impress magnetic flux on the action space 3 between the cathode 1 and the anode 2, and magnetic circuits comprising magnets 5 and magnetic poles 6 are provided in the upper side of the upper yoke 30 and the lower side of the lower yoke 20 respectively, and an antenna feeder 7, an antenna seal 8, an antenna ceramic 9 and an antenna cap 10 are provided to discharge micro-wave energy transmitted from anode 2 to the outside(cavity).

Also heat dissipation fins 11 are arranged on the outer side of the anode 2 to dissipate the heat generated by the collisions of thermions (thermal electrons) from anode vanes 2*a* to the outside, and a choke coil 12 and a high voltage capacitor 13 both protected by a filter box 14 are provided under the lower yoke 20 to prevent the electric source from the backward flow of the unnecessary micro-wave energy generated in the action space 3.

In this way, the thermions emitted from the cathode 1 evolve along cycloidal orbits due to the electric field in the action space 3 impressed by and between the edges of anode vanes 2*a* positioned inside of anode 2 and cathode 1, and a magnetic field is impressed by the magnetic circuit comprising the magnets 5 and magnetic poles 6, and transmits the energy to anode vanes 2*a*, and this energy is discharged into an electronic range through an output part comprising an antenna feeder 7 contacting with anode vanes 2*a*, an antenna ceramic 9 and an antenna seal 8.

The upper and lower yokes 30 and 20, in a magnetron as described above, the upper yoke 30 having an inverted channel section or plane section and the lower yoke 20 having a channel section, are joined to form a square section so as to join not only the elements forming magnetic circuits but also above magnets 5 to a magnetron body mechanically and, at the same time, function as a joining part when a magnetron is mounted on an electronic range, Referring to FIG. 2, when a magnetron with upper yoke 30, lower yoke 20 and high voltage capacitor 13 is to be mounted on an electronic range, there is such a case, inevitably, that the direction of the joining parts 33 connected to sidewalls 31*b* and plane part 31*a* of magnetic circuit part 31 are parallel to the heat dissipation fins 11 and perpendicular to antenna cap 10.

In this case, in a conventional magnetron as shown in FIG. 3, the upper yoke 30 comprises a magnetic circuit part 31 inverted channel sectioned by bending, bent-up parts 32 bent up to overlap with both magnetic circuit part 31 side walls 31*b* respectively, and joining parts 33 extended from the edge of bent up parts 32 to outside parallel with plane part 31*a* of magnetic circuit part 31.

Bolt holes 33*a* are provided in joining parts 33 to join with an electronic range.

Accordingly, in case when the upper yoke 30 mentioned above had been joined onto an electronic range, breakages have been frequently observed in the bent-up parts 32 end the joining parts 33 due to the stress generated by the weight of a magnetron itself on the bent-up parts 32 and the joining parts 33, and damage to the production dies used in the manufacture of the upper yoke 30 have been experienced due to the complicated configuration of the production dies designed to form the upper yoke 30 having magnetic circuit 31, bent up parts 32 and joining parts 33 out of a piece of steel plate.

SUMMARY OF THE INVENTION

The present invention has been made in view of the above described problems occuring in the prior art magnetron yoke joints and an object of the present invention is to provide magnetron yoke joints which will prevent the breakages of an upper yoke and extend the life of the production dies for the upper yoke.

Another object of the present invention is to provide one combined joining provision for the joining of the upper and the lower yokes of a magnetron and the joining of a magnetron onto an electronic range.

In accordance with the present invention, the object mentioned above can be accomplished by providing magnetron yokes having joining lugs in lower yoke which are upward protrusions from the upper edges of the side walls of the channel sectioned lower yoke and catches in inverted channel sectioned upper yoke provided to be joined with above mentioned joining lugs in the lower yoke, joining the upper and lower yokes by means of above joining lugs and catches, forming a magnetic space therein, and mounting a magnetron onto an electronic range by means of above joining lugs.

BRIEF DESCRIPTION OF THE DRAWINGS

These and other objects, features and advantages of the present invention will become more apparent upon a reading of the following detailed specification and drawings, in which.

DETAILED DESCRIPTION OF THE INVENTION

Figure 1:
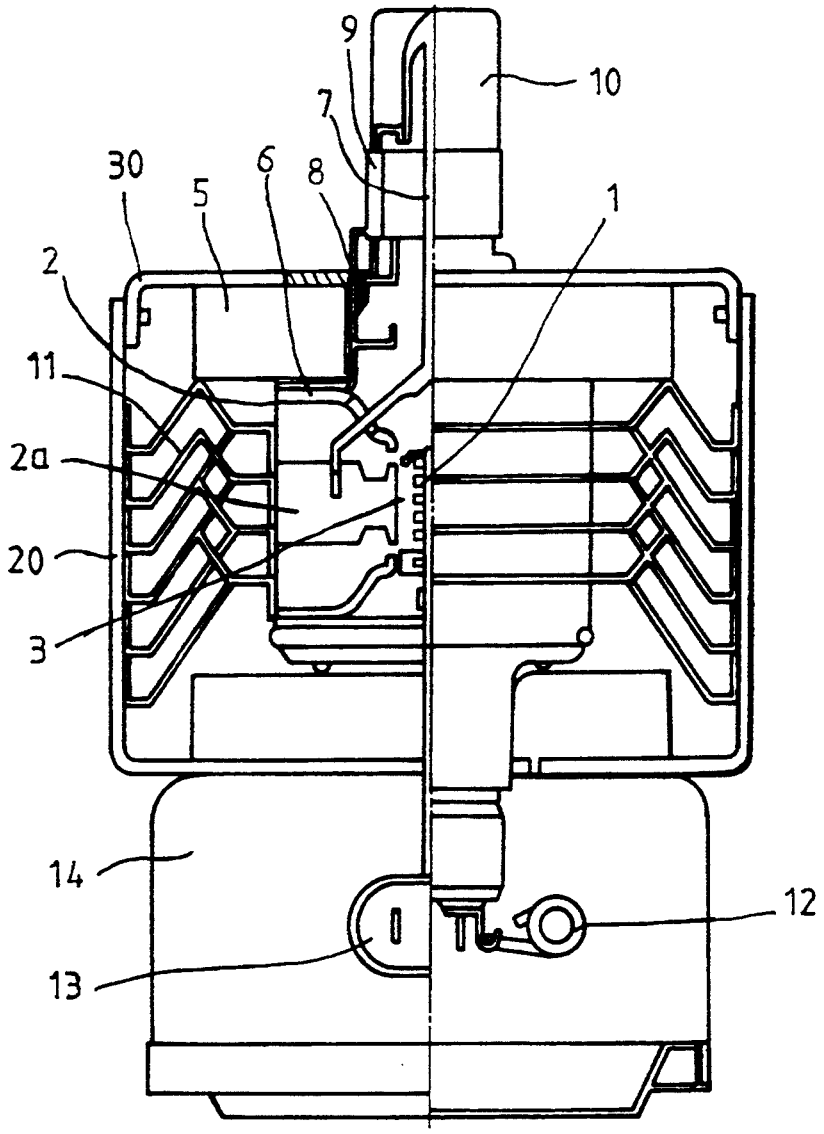
FIG. 1 PRIOR ART
FIG. 1 is a half sectional view of a conventional magnetron.
Figure 2:
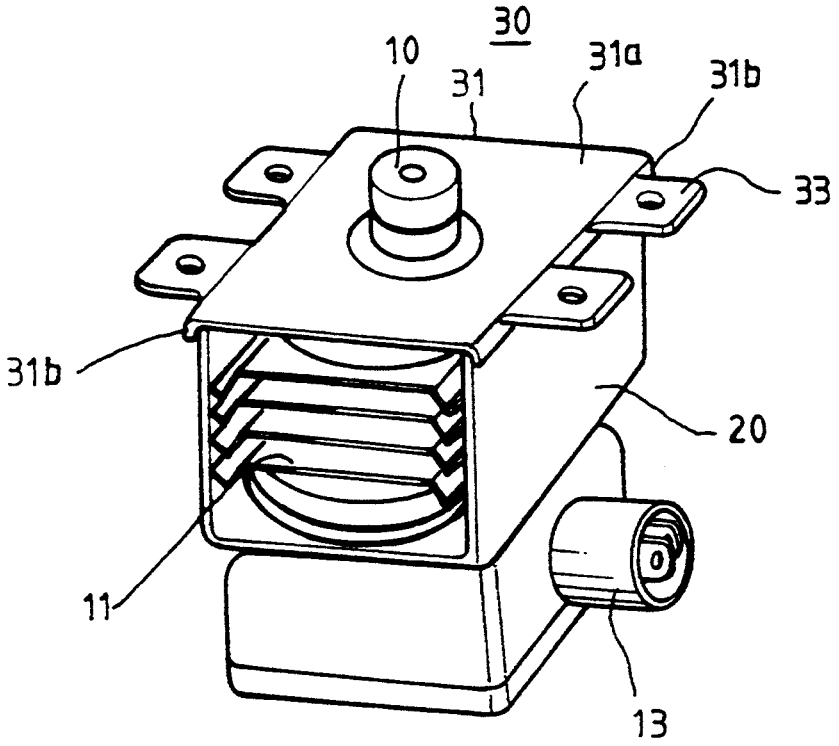
FIG. 2 PRIOR ART
FIG. 2 is a perspective view of a conventional magnetron, shown in yokes joined vertical to heat dissipation fins.
Figure 3:
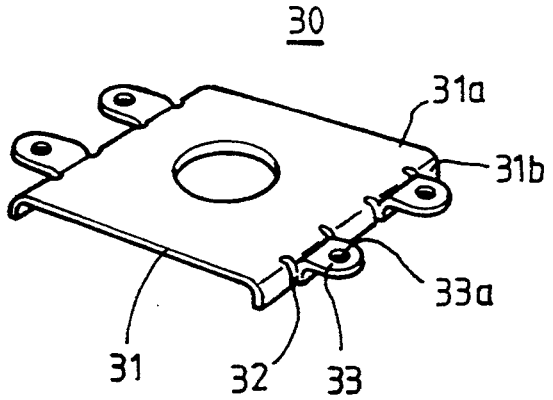
FIG. 3 PRIOR ART
FIG. 3 is a perspective view of an upper yoke shown in FIG. 2.
Figure 4:
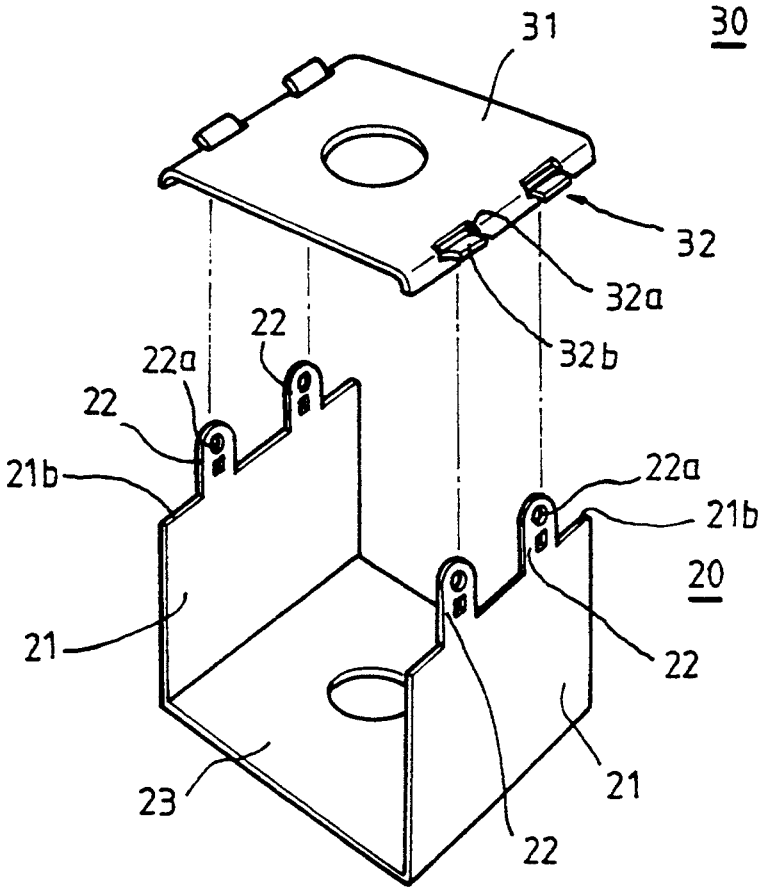
FIG. 4 is an exploded perspective view of the upper and lower yokes of a magnetron in accordance with the present invention.

Referring to FIG. 4, there is shown an example of an upper and a lower yokes of a magnetron in accordance with the present invention in an exploded perspective view, wherein the channel sectioned lower yoke 20 has joining lugs 22 protruded upward from the upper edges 21*b* of two side walls 21, two lugs per each wall, vertically extended from each end of a plane part 23 of the lower yoke 20 respectively. The joining lugs 22 have bolt holes 22*a* respectively to mount a magnetron onto an electronic range.

The upper yoke 30 has catches 32 on magnetic insert part 31 to be joined respectively with the joining lugs 22 of the lower yoke 20. The catches 32 have pass-through holes 32*a* respectively for the joining lugs of the lower yoke 20 in corresponding positions. And lips 32*b* protrude out to outsides from the outer edges of the pass-through holes.

Figure 5:
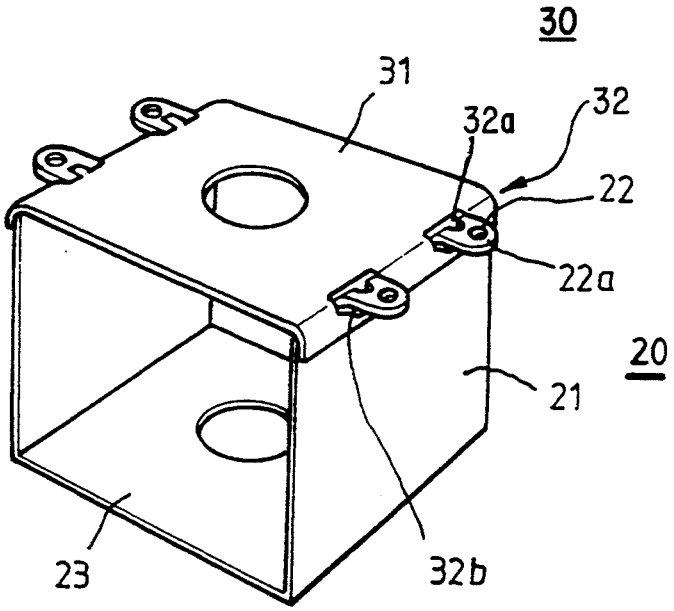
FIG. 5 is a assembled perspective view of the upper and lower yokes of a magnetron in accordance with the present invention.

The joining lugs 22 in the lower yoke 20 having side walls 21 and plane part 23, after having passed through the pass through holes of the catches 32 respectively, bend to outsides of the upper yoke 30 respectively and the lips 32*b* support the bent joining lugs 22 respectively, FIG. 5 shows the condition after the joining lugs 22 of the lower yoke 20 have passed through the pass-through holes of the catches 32 respectively and have bent outside respectively.

The bent joining lugs 22 are to join a magnetron onto an electronic range through the bolt holes 22*a*.

Figure 6:
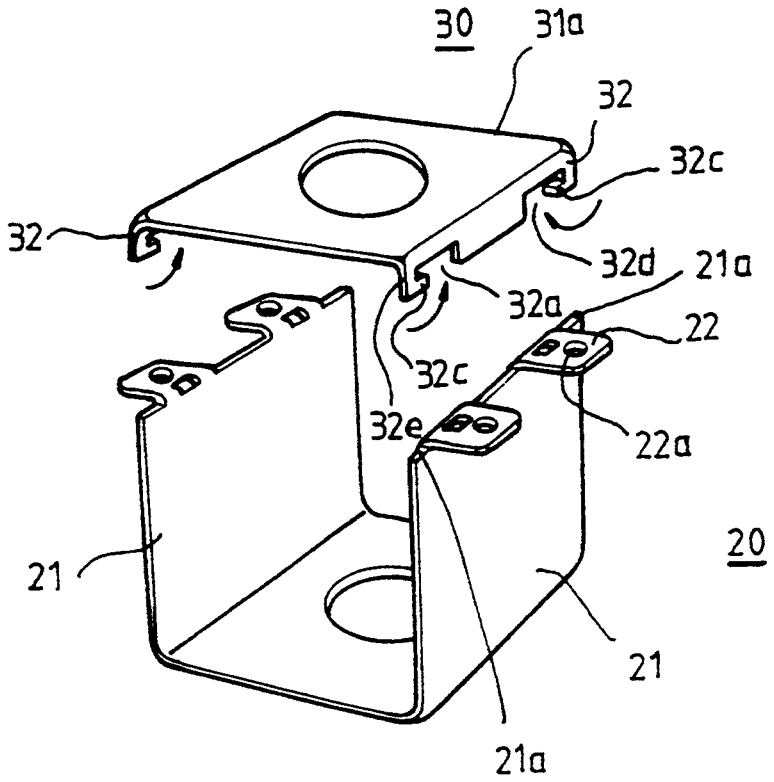
FIG. 6 is a exploded perspective view of another upper and lower yokes of a magnetron in accordance with the present invention.

On the other hand, shown in FIG. 6 is another example of the present invention wherein the joining lugs 22 having bolt holes 22*a* protrude out from the upper edges 21*a* of the two side walls 21 of the lower yoke 20, two lugs per each wall, have been bent at 90 degrees to the outsides of the side walls 21 respectively, and the side walls 32 extended from each end of the plane part 31*a* of the upper yoke 30 respectively downward vertically, have cut out spaces 32*d*, two said spaces per each wall, the bent joining lugs 22 of the upper yoke 20 to be inserted into holes 32*a*.

Also the side walls 32 of the upper yoke 30 have supporting tips 32*c* extended from lower corners 32*e* of the side walls 32 toward the cut out spaces 32*d* respectively.

Figure 7:
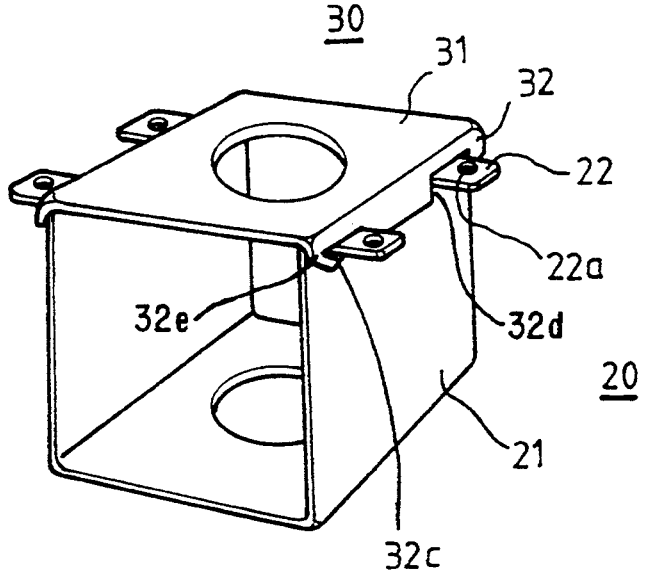
FIG. 7 is a assembled perspective view of another upper and lower yokes of a magnetron in accordance with the present invention.

The joining lugs 22 of the lower yoke, after having been inserted into the cut out spaces 32*d* respectively, as shown in FIG. 7, press the respective supporting tips 32*c* extended from the lower corners 32*e* respectively, inside at the lower corners 32*e* of the side walls 32 of the upper yoke 30, as shown by the arrow on the FIG. 6 to bend to support the respective joining lugs 22.

After the upper yoke 30 and lower yoke 20 are joined together, a magnetron is mounted on an electronic range using the bolt holes 22*a* in respective joining lugs 22 of the lower yoke 20.

Operation of the magnetron yoke joint according to the present invention will be described as follows.

As shown in FIG. 5, after insertion of the respective joining lugs 22 of the lower yoke 20 through the respective pass through holes 32*a* of the respective catches 32 of plane part 31 of the upper yoke 30, the upper yoke 30 and the lower yoke 20 having side walls 21 and plane part 23 are joined together by bending the respective joining lugs 22 of the lower yoke 20 at 90 degree outside of the upper yoke 30 and a magnetron can be fixed on an electronic range using the respective bolt holes 22*a* in above bent joining lugs 22 of the lower yoke 20. Also as shown in FIG. 7, after inserting the previously bent joining lugs 22 of the lower yoke 20 having sides 21 to the cut-out spaces 32*d* respectively, the supporting tips 32*c* are bent inside into the cut-out spaces 32*d* respectively to join the upper yoke 30 having plane part 31 and catches 32 and the lower yoke 20 together, thereafter a magnetron can be fixed on an electronic range using the bolt holes 22*a* in respective joining lugs 22 of the lower yoke 20.

As mentioned above, in accordance with the present invention, when a magnetron is mounted on an electronic range, and in case the joining bolts of a magnetron need to be arranged at right angle to the direction of cooling air flow, not providing the joining parts in the upper yoke but providing the joining parts in the lower yoke, it is possible to prevent the breakages of the upper yoke caused by the forming of the bent joining parts in the upper yoke, extend the life of production dies, and manufacture the upper and lower yokes more easily.

Also the provision for joining the upper and the lower yokes and the provision for mounting a magnetron on an electronic range are made not separately but in combination so as to join the upper and lower yokes and the mounting of a magnetron onto an electronic range with one provision. Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. Yoke joint for a magnetron which generates microwaves, said yoke joint comprising:

(a) a lower yoke having a horizontal plane part with first and second side walls extending vertically upward, the first and second side walls having respective first and second upper edges, said lower yoke including joining lugs protruding from the first and second upper edges of the first and second side walls, the joining lugs having holes for fixing the yoke joint to a surface; and (b) an upper yoke positioned above said lower yoke and having pass through holes in positions corresponding to said joining lugs to receive said joining lugs, wherein said joining lugs are in a bent configuration over said pass through holes and said joining lugs connect the yoke joint to the surface using said holes in said joining lugs.

2. Yoke joint as claimed in claim 1, wherein said upper yoke further includes supporting lips supporting said joining lugs of said lower yoke and extending from below said pass through holes of said upper yoke.

3. Yoke joint for a magnetron which generates microwaves, said yoke joint comprising:

(a) a lower yoke having a horizontal plane part with first and second side walls extending vertically upward, the first and second side walls having respective first and second upper edges, said lower yoke including joining lugs protruding from the first and second upper edges of the first and second side walls, the joining lugs having holes for fixing the yoke joint to a surface; and (b) an upper yoke positioned above said lower yoke and having pass through slots with supporting tips in positions corresponding to said joining lugs to receive said joining lugs, wherein said joining lugs are in a bent configuration over said supporting tips and said joining lugs connect the yoke joint to the surface using said holes in said joining lugs.

* * * * *